US007455599B2

(12) United States Patent
Jones

(10) Patent No.: US 7,455,599 B2
(45) Date of Patent: Nov. 25, 2008

(54) GOLF PUTTER HEAD WITH TOP AND BOTTOM COMPONENTS MADE OF MATERIALS HAVING DIFFERENT DENSITIES

(75) Inventor: David D. Jones, Glendale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 211 days.

(21) Appl. No.: 11/392,338

(22) Filed: Mar. 29, 2006

(65) Prior Publication Data

US 2007/0238547 A1 Oct. 11, 2007

(51) Int. Cl.
*A63B 53/04* (2006.01)

(52) U.S. Cl. ..... 473/340; 473/350; 473/341

(58) Field of Classification Search ..... None
See application file for complete search history.

(56) References Cited

U.S. PATENT DOCUMENTS 5,482,281 A 1/1996 Anderson
5,842,935 A 12/1998 Nelson
6,471,600 B2 10/2002 Tang et al.
6,902,496 B2 6/2005 Solheim et al.
6,960,140 B2 11/2005 Solheim
6,984,181 B2 * 1/2006 Hettinger et al. ..... 473/340
7,229,362 B2 * 6/2007 Tavares ..... 473/349
2005/0003902 A1 1/2005 Reese

FOREIGN PATENT DOCUMENTS

JP 11114112 A * 4/1999
JP 2004290565 A * 10/2004

* cited by examiner

*Primary Examiner*—Gene Kim
*Assistant Examiner*—Alvin A Hunter
(74) *Attorney, Agent, or Firm*—Darrell F. Marquette

(57) ABSTRACT

A golf putter head includes a face arranged for impacting a golf ball. The face has a heel end, a toe end, and a middle section disposed between the heel and toe ends. A rear mass is located substantially rearwardly of the face, and a pair of arms extend rearwardly from the face toward the rear mass. Portions of the heel and toe ends of the face, the arms and the rear mass are included in a bottom component. Other portions of the heel and toe ends of the face and the middle section of the face are included in a top component. The bottom component is made of high density material such as metal while the top component is made of low density material such as polymer in order to provide the putter head with a low center of gravity.

26 Claims, 5 Drawing Sheets

GOLF PUTTER HEAD WITH TOP AND BOTTOM COMPONENTS MADE OF MATERIALS HAVING DIFFERENT DENSITIES

BACKGROUND OF THE INVENTION

This invention relates generally to golf equipment and, in particular, to a golf putter head with top and bottom components made of materials having different densities.

Recent developments in golf equipment have resulted in putters with heads that have higher moments of inertia. For example, U.S. Pat. No. 5,482,281 to D. W. Anderson discloses a putter head sold under the name DANSER. The Anderson putter head has heel and toe weights mounted on a lower plate-like member. The heel and toe weights and the lower plate-like member are preferably made of heavyweight material such as bronze or steel. An upper shell-like member, preferably made of lightweight material such as plastic or aluminum, is secured to the lower plate-like material to enclose the heel and toe weights. U.S. Pat. No. 5,842,935 to M. J. Nelson discloses a putter head sold under the name NELLI. The Nelson putter head has a horseshoe shaped body formed of high density material such as steel with thickened heel and toe portions. The horseshoe shaped body includes a cavity which receives an insert formed of low density material such as polyurethane. The insert preferably constitutes about 15% of the total weight of the putter head while constituting more than 50% of the total volume of the putter head. Further, U.S. Pat. No. 6,960,140 to J. A. Solheim et al discloses a putter head sold under the name CRAZE. The Solheim et al putter head includes a central member connected to a face member. The central member has a thickened portion located rearward of the face member, and a pair of arms extend rearward from heel and toe ends of the face member.

SUMMARY OF THE INVENTION

The present invention provides a golf putter head comprising a face arranged for impacting a golf ball, the face having a heel end, a toe end, and a middle section disposed between the heel and toe ends. A rear mass is located substantially rearward of the face, and an arm extends rearwardly from the face toward the rear mass. Portions of the heel and toe ends of the face, the arm and the rear mass are included in a bottom component that is made of a first material having a first density. Other portions of the heel and toe ends of the face and the middle section of the face are included in a top component that is made of a second material having a second density which is substantially less than the first density. The first material is preferably metal whereas the second material is preferably polymer.

In the preferred embodiment of the golf putter head, the top component is attached to the bottom component by fasteners. A plurality of projections on the top component fit into a plurality of holes in the bottom component. One of the projections and one of the holes are located at the heel end of the face, and another one of the projections and another one of the holes are located at the toe end of the face. One of the fasteners is located at the heel end of the face while another one of the fasteners is located at the toe end of the face. Lower portions of the heel and toe ends of the face are included in the bottom component. Upper portions of the heel and toe ends of the face are included in the top component.

DESCRIPTION OF THE INVENTION

Figure 1:
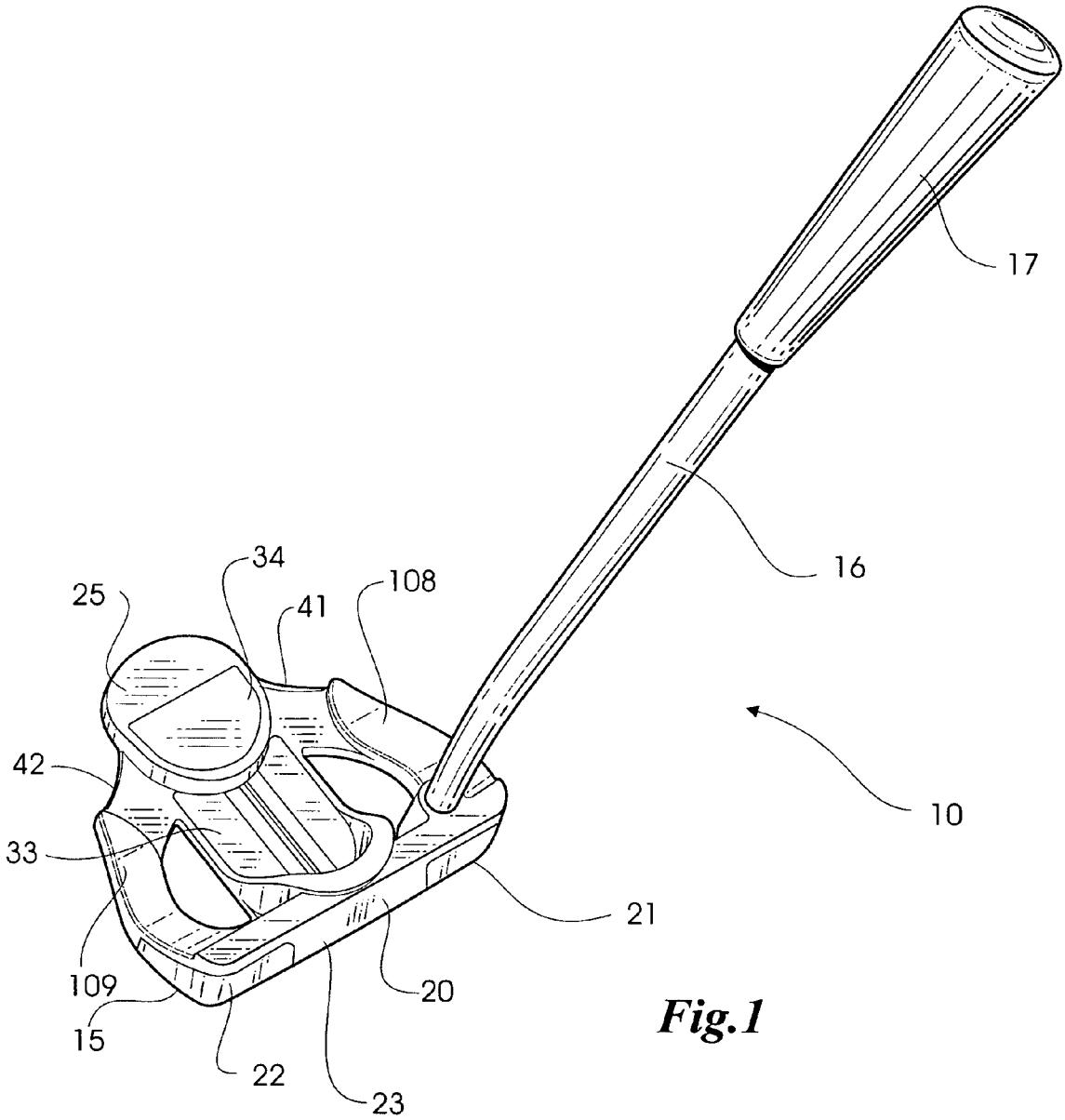
FIG. 1 is a perspective view of a golf putter head in accordance with the invention shown attached to a shaft.
Figure 2:
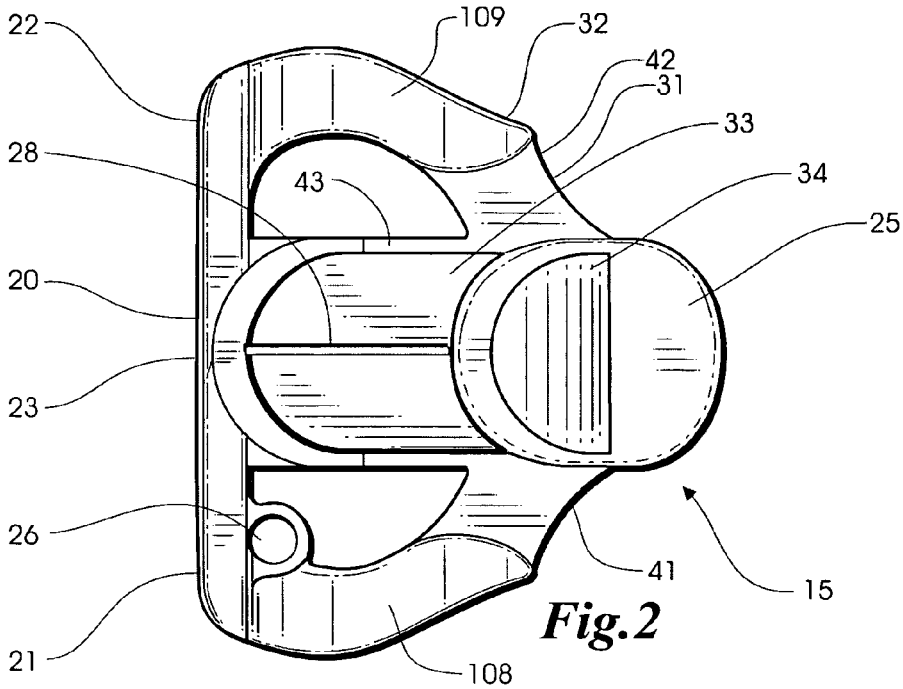
FIG. 2 is a top view of the golf putter head shown in FIG. 1.

A golf putter 10 includes a putter head 15, a shaft 16, and a grip 17. A lower end of the shaft 16 is inserted in a hosel 26 on the putter head 15, and the grip 17 is attached to an upper end of the shaft 16. When assembled as shown in FIG. 2, the putter head 15 includes a face 20 which is arranged for impacting a golf ball. The face 20 has a heel end 21, a toe end 22, and a middle section 23 disposed between the heel and toe ends 21, 22. Putter head 15 also includes a rear mass 25 located substantially rearward of the face 20. First and second arms 41 and 42 extend rearwardly from the heel and toe ends 21, 22 of the face 20, respectively, toward the rear mass 25. A third arm 43 extends from the middle section 23 of the face 20 toward the rear mass 25.

Figure 3:
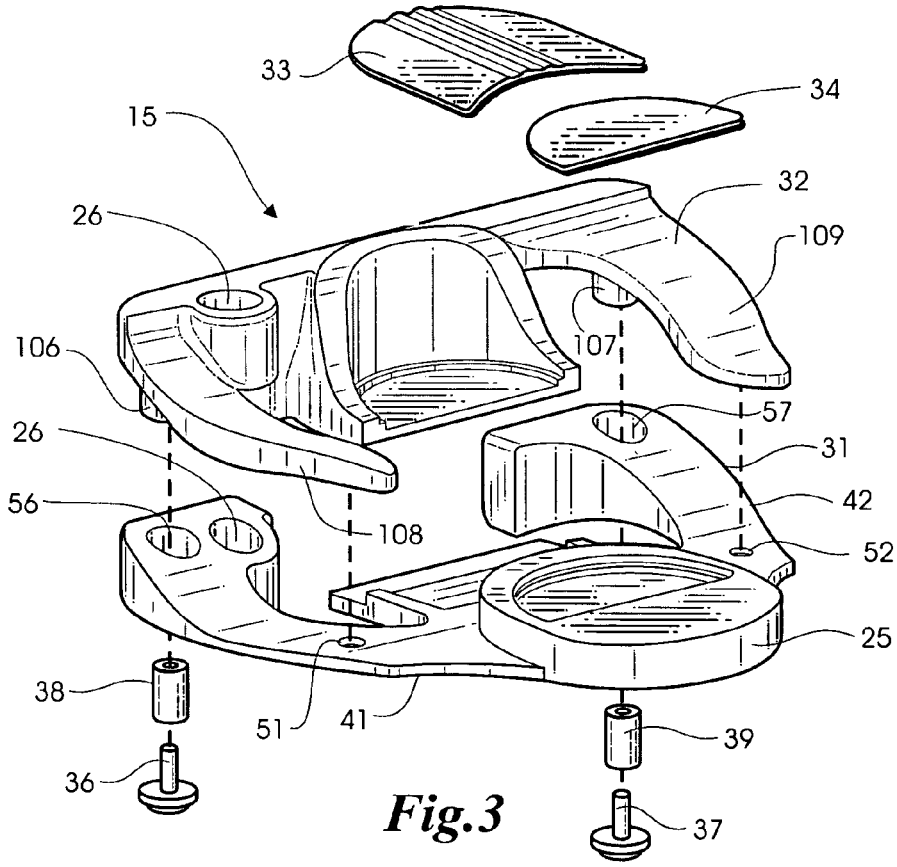
FIG. 3 is an exploded view of the golf putter head shown in FIG. 2.
Figure 4:
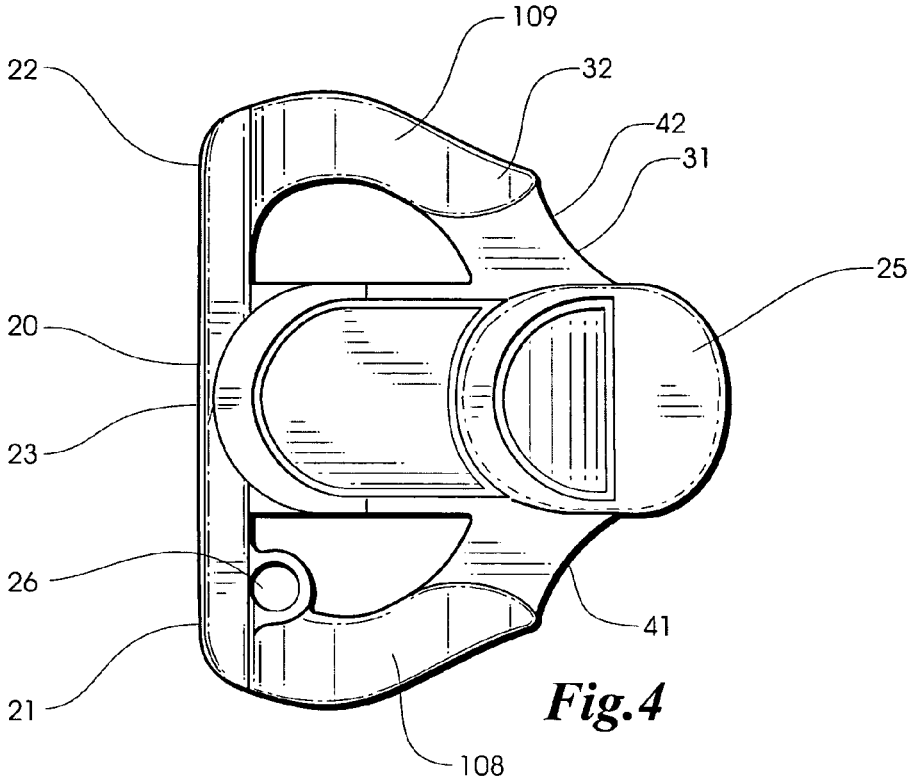
FIG. 4 is a top view of the golf putter head shown in FIG. 2.
Figure 5:
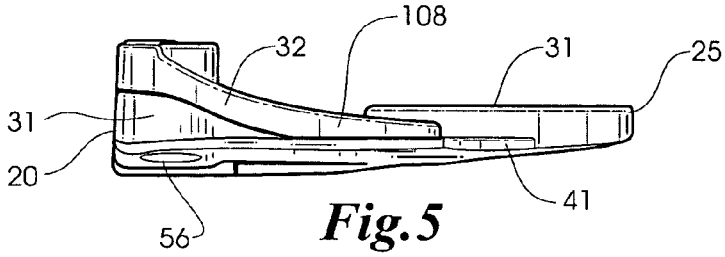
FIG. 5 is a side view of the golf putter head shown in FIG. 2.
Figure 6:
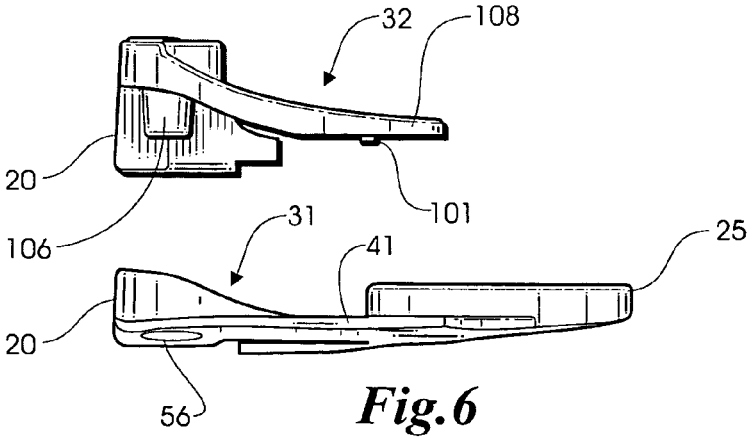
FIG. 6 is an exploded side view of the golf putter head shown in FIG. 2.
Figure 7:
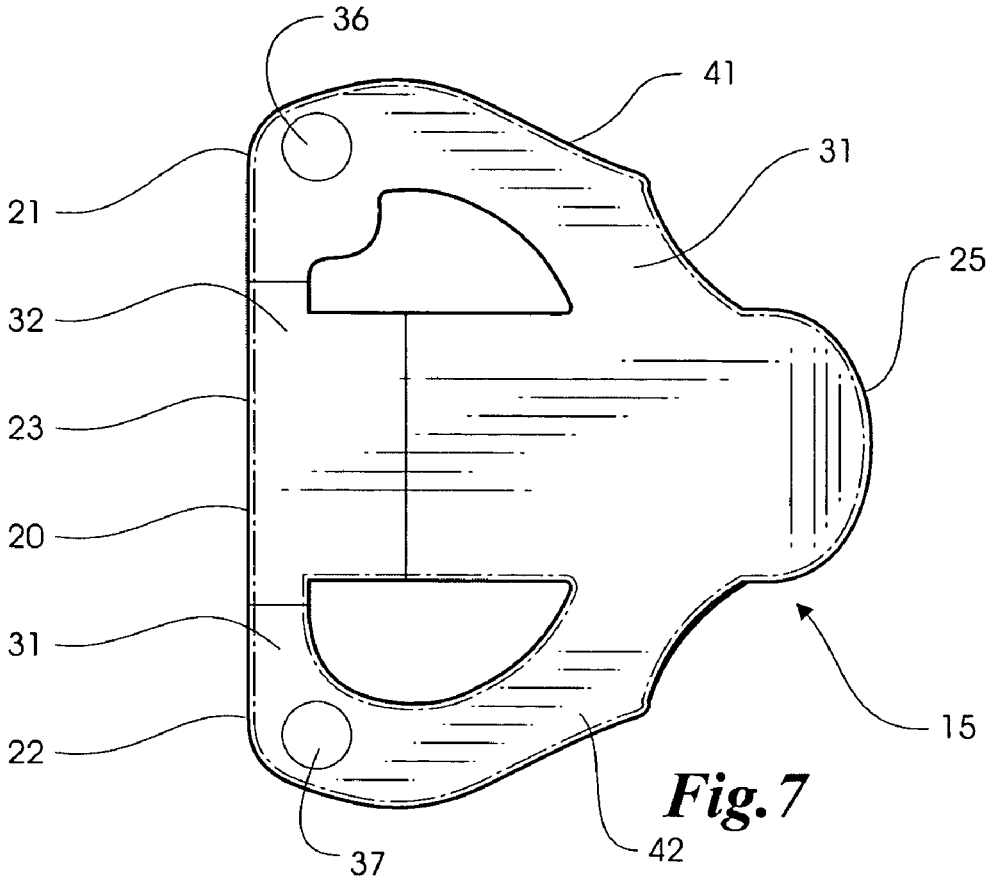
FIG. 7 is a bottom view of the golf putter head shown in FIG. 2.
Figure 8:
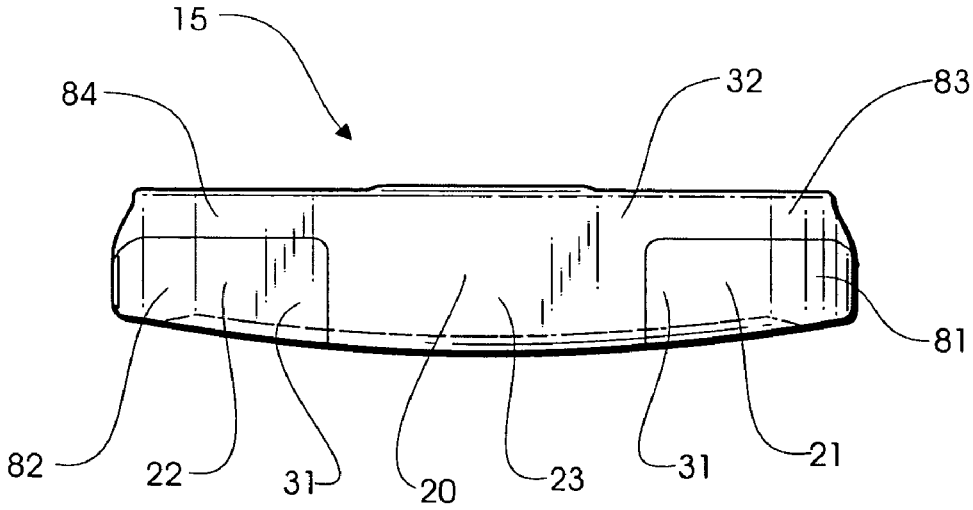
FIG. 8 is a front view of the golf putter head shown in FIG. 2.
Figure 9:
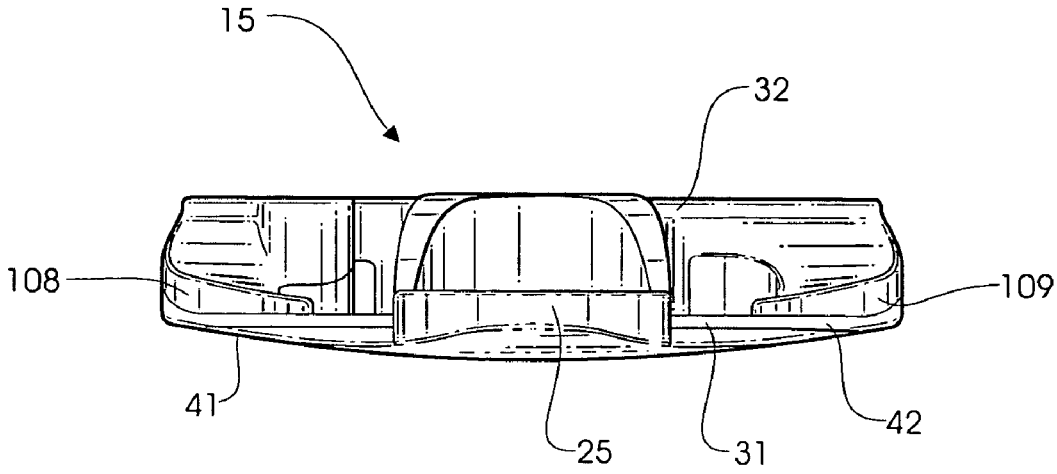
FIG. 9 is a rear view of the golf putter head shown in FIG. 2.
Figure 10:
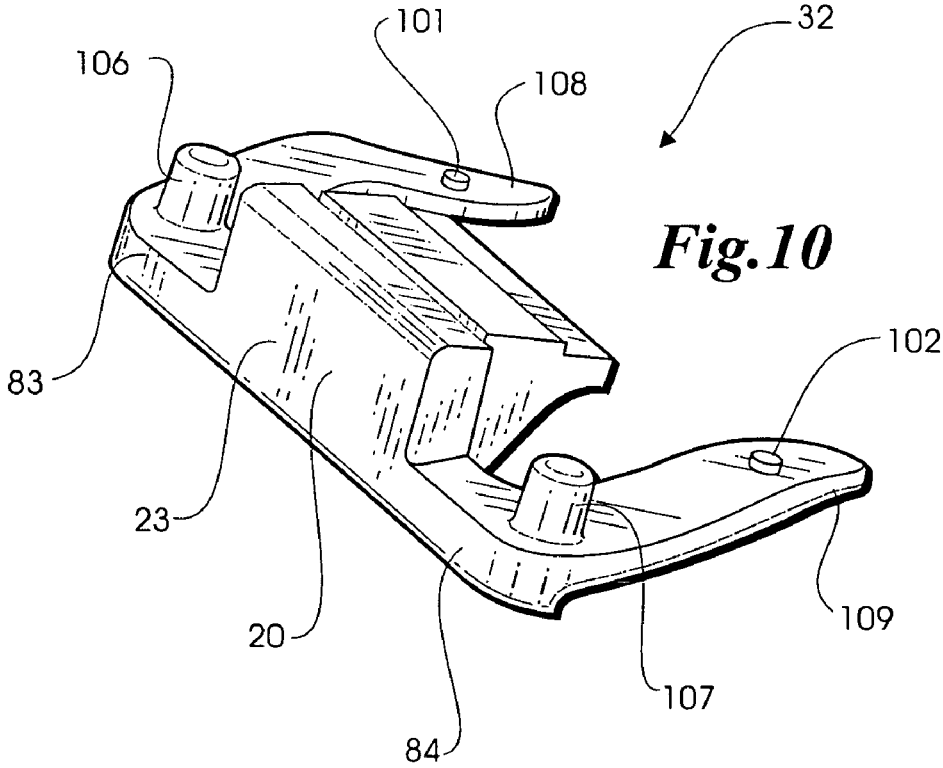
FIG. 10 is a perspective view of the golf putter head shown in FIG. 2.

As shown in the exploded view in FIG. 3, the putter head 15 includes a bottom component 31, a top component 32, a front insert 33, a rear insert 34, fasteners such as screws 36 and 37, and bushings 38 and 39. Top component 32 is made of a first or low density material such as polymer having a first density, and bottom component 31 is made of a second or high density material such as metal having a second density. The first density is substantially less than the second density so that the putter head 15 will have a low center of gravity. In the preferred embodiment, the first density is no more than half the second density. The bottom component 31 is preferably made of steel or tungsten while the top component is preferably made of polymer or carbon fiber.

The putter head 15 is configured to have a relatively high moment of inertia. To accomplish this high moment of inertia, weight is concentrated at or near face heel end 21, face toe end 22 and rear mass 25. A lower portion 81 of the face heel end 21, a lower portion 82 of the face toe end 22, the arms 41 and 42, and the rear mass 25 are all formed as parts of the bottom component 31. The face middle section 23, an upper portion 83 of the face heel end 21 and an upper portion 84 of the face toe end 22 are formed as parts of the top component 32. The top component 32 includes wing portions 108, 109 that are disposed on top of the arms 41, 42 of the bottom component 31.

Fasteners or screws 36 and 37 attach the top component 32 to the bottom component 31 by extending through the bushings 38 and 39 (which are inserted in holes 56, 57 in the bottom component 31) and then threading into projections 106, 107 on the top component 32. Screw 36 is located at the heel end 21 of the face 20 while screw 37 is located at the toe end 22 of the face 20. A suitable adhesive may also be used when attaching the top component 32 to the bottom component 31. The projections 106, 107 and other projections 101, 102 fit or project into the holes 56, 57 and other holes 51, 52. The projections 101, 102 are formed on the wing portions 108, 109 of the top component 32, and the holes 51, 52 are formed in the arms 41, 42 of the bottom component 31. The projection 106 and the hole 56 are located at the heel end 21 of the face 20, and the projection 107 and the hole 57 are located at the toe end 22 of the face 20.

If desired, holes 56, 57 and projections 106, 107 may be slightly tapered. Also, holes 51, 52 and projections 101. 102 may be slightly tapered. With projections 101, 102, 106 and 107 fitting or projecting into holes 51, 52, 56 and 57, lateral movement between bottom component 31 and top component 32 is prevented.

Inserts 33 and 34 are attached to bottom component 31, top component 32, or both, with adhesive or double-sided tape. Inserts 33 and 34 may be made of polymer or plastic and may include an alignment aid. As shown in FIG. 2, such an alignment aid may be a line 28 on front insert 33.

What is claimed is:

1. A golf putter head comprising:

a face arranged for impacting a golf ball, the face having a heel end, a toe end, and a middle section disposed between the heel and toe ends;

a rear mass located substantially rearward of the face;

an arm extending rearwardly from the face toward the rear mass;

lower portions of the heel and toe ends of the face, the arm and the rear mass being included in a bottom component that is made of a first material having a first density;

upper portions of the heel and toe ends of the face and the entire middle section of the face being included in a top component that is made of a second material having a second density which is substantially less than the first density; and the lower portions of the heel and toe ends of the face being larger than the upper portions of the head and toe ends of the face.

2. The golf putter head of claim 1, wherein:

the arm extends rearwardly from the heel end of the face toward the rear mass; and another arm extends rearwardly from the toe end of the face toward the rear mass.

3. The golf putter head of claim 1, wherein the bottom component is formed of metal and wherein the top component is formed of polymer.

4. The golf putter head of claim 1, wherein the top component is attached to the bottom component by fasteners.

5. The golf putter head of claim 4, further comprising a plurality of projections on the top component that fit into a plurality of holes in the bottom component.

6. The golf putter head of claim 5, wherein:

one of the projections and one of the holes are located at the heel end of the face; and another one of the projections and another one of the holes are located at the toe end of the face.

7. The golf putter head of claim 6, wherein:

one of the fasteners is located at the heel end of the face; and another one of the fasteners is located at the toe end of the face.

8. The golf putter head of claim 1, wherein the lower and upper portions of the heel and toe ends of the face are substantially rectangular in shape.

9. A golf putter head comprising:

a face arranged for impacting a golf ball, the face having a heel end, a toe end, and a middle section disposed between the heel and toe ends;

a rear mass located substantially rearward of the face;

a first arm extending rearwardly from the heel end of the face toward the rear mass;

a second arm extending rearwardly from the toe end of the face toward the rear mass;

lower portions of the heel and toe ends of the face, the first and second arms, and the rear mass being formed as parts of a bottom component that is made of a first material having a first density;

upper portions of the heel and toe ends of the face and the entire middle section of the face being formed as parts of a top component that is made of a second material having a second density which is substantially less than the first density; and the lower portions of the heel and toe ends of the face being larger than the upper portions of the head and toe ends of the face.

10. The golf putter head of claim 9, wherein the first material comprises metal and wherein the second material comprises polymer.

11. The golf putter head of claim 9, further comprising:

a third arm extending rearwardly from the middle section of the face toward the rear mass; and the third arm being formed as part of the bottom component.

12. The golf putter head of claim 9, further comprising a plurality of fasteners for attaching the top component to the bottom component.

13. The golf putter head of claim 12, further comprising a plurality of projections on the top component that fit into a plurality of holes in the bottom component.

14. The golf putter head of claim 13, wherein:

one of the projections and one of the holes are located at the heel end of the face; and another one of the projections and another one of the holes are located at the toe end of the face.

15. The golf putter head of claim 14, wherein:

one of the fasteners is located at the heel end of the face; and another one of the fasteners is located at the toe end of the face.

16. The golf putter head of claim 15, wherein the top component includes first and second wing portions that are disposed on top of the first and second arms, respectively, of the bottom component.

17. The golf putter head of claim 16, wherein further ones of the projections are located on the first and second wing portions.

18. The golf putter head of claim 17, wherein further ones of the holes are located in the first and second arms for receiving the further ones of the projections.

19. The golf putter head of claim 9, wherein the lower and upper portions of the heel and toe ends of the face are substantially rectangular in shape.

20. A golf putter head comprising:

a face arranged for impacting a golf ball, the face having a heel end, a toe end, and a middle section disposed between the heel and toe ends;

a lower portion of the heel end of the face and a lower portion of the toe end of the face being included in a bottom component;

an upper portion of the heel end of the face, an upper portion of the toe end of the face, and the entire middle section of the face being included in a top component:

the bottom component being made of high density material;

the top component being made of low density material; and the lower portions of the heel and toe ends of the face being larger than the upper portions of the head and toe ends of the face.

21. The golf putter head of claim 20, wherein the high density material is metal and wherein the low density material is polymer.

22. The golf putter head of claim 20, further comprising a plurality of projections on the top component that fit into a plurality of holes in the bottom component.

23. The golf putter head of claim 22, wherein the top component is attached to the bottom component by fasteners.

24. The golf putter head of claim 23, wherein:

one of the projections and one of the holes are located at the heel end of the face; and another one of the projections and another one of the holes are located at the toe end of the face.

25. The golf putter head of claim 24, wherein:

one of the fasteners is located at the heel end of the face; and another one of the fasteners is located at the toe end of the face.

26. The golf putter head of claim 20, wherein the lower and upper portions of the heel and toe ends of the face are substantially rectangular in shape.

* * * * *